US007369979B1

(12) United States Patent
Spivey

(10) Patent No.: US 7,369,979 B1
(45) Date of Patent: May 6, 2008

(54) METHOD FOR CHARACTERIZING AND FORECASTING PERFORMANCE OF WELLS IN MULTILAYER RESERVOIRS HAVING COMMINGLED PRODUCTION

(76) Inventor: John Paul Spivey, 8401 Wildewood Cir., College Station, TX (US) 77845

( * ) Notice: Subject to any disclaimer, the term of this patent is extended or adjusted under 35 U.S.C. 154(b) by 256 days.

(21) Appl. No.: 11/224,414

(22) Filed: Sep. 12, 2005

(51) Int. Cl.
*G06G 7/48* (2006.01)

(52) U.S. Cl. ..... 703/8; 703/2; 703/6; 703/9; 702/6; 702/9; 702/12

(58) Field of Classification Search ..... 703/10, 703/2, 6, 9; 702/2, 6, 7, 11, 13, 14, 16, 19, 702/21, 23, 50, 75, 125; 73/38, 53.01, 152.05, 73/152.55, 866.5
See application file for complete search history.

(56) References Cited

U.S. PATENT DOCUMENTS

| | | | | |
|---|---|---|---|---|
| 4,799,157 | A | 1/1989 | Kucuk et al. | |
| 4,803,873 | A | 2/1989 | Ehlig-Economides | |
| 5,247,829 | A | 9/1993 | Ehlig-Economides | |
| 5,305,209 | A | 4/1994 | Stein et al. | |
| 5,764,515 | A | 6/1998 | Guerillot et al. | |
| 5,960,369 | A | 9/1999 | Samaroo | |
| 6,101,447 | A | 8/2000 | Poe, Jr. | |
| 6,571,619 | B2 * | 6/2003 | Herron et al. | 73/152.14 |
| 2002/0043370 | A1 | 4/2002 | Poe | |
| 2002/0096324 | A1 | 7/2002 | Poe, Jr. | |

FOREIGN PATENT DOCUMENTS

| | | | |
|---|---|---|---|
| CA | 2421863 | A1 | 3/2003 |
| EA | 4518 | B1 | 6/2004 |
| WO | WO-02/23011 | A1 | 3/2002 |

OTHER PUBLICATIONS

Department of Energy—Hydraulic Fracturing White Paper, Evaluation of Impacts to Underground Sources of Drinking Water by Hydraulic Fracturing of Coalbled Methane Reservoirs, Appendix A, Jun. 2004.*

Z. Tavassoli, Jonathan N. Carter and Peter R. King; Imperial College, London; Errors in History Matching; Sep. 2004 SPE Journal; pp. 352-361.*

Fetkovich, M.J.: "Decline Curve Analysis Using Type Curves," Journal of Petroleum Technology, (Jun. 1980) pp. 1065-1077.

Shah, P.C. et al. "Estimation of the Permeabilities and Skin Factors in Layered Reservoirs Using Downhole Rate and Pressure Data," SPE 14131, Intl Mtg on Petr. Eng. Mar. 17-20, 1988.

(Continued)

*Primary Examiner*—Paul Rodriguez
*Assistant Examiner*—Jonathan J Teets

(57) ABSTRACT

A method for forecasting performance for and characterizing the properties of a multilayer low permeability gas reservoir. The method includes a coupled well/reservoir predictive model that accounts for pressure drop between layers, allowing accurate, rigorous, and rapid forecasting of reservoir performance. The method provides estimates of individual layer properties such as in-situ permeability, skin factor, fracture half-length, fracture conductivity, drainage area, etc. by simultaneously history matching production data and production log data using the coupled well/reservoir predictive model.

14 Claims, 8 Drawing Sheets

OTHER PUBLICATIONS

Fraim and Wattenbarger "Gas Reservoir Decline-Curve Analysis Using Type Curves With Real Gas Pseudopressure and Normalized Time," SPE Form. Eval. (Dec. 1987) pp. 671-682.

Watson, A.T., Lane, H.S., and Gatens, J.M., III: "History Matching With Cumulative Production Data,"Jour. of Petroleum Technology (Jan. 1990) 96-100.

Watson, A.T. et al: "An Analytical Model for History Matching Naturally Fractured Reservoir Production Data," SPE Reservoir Engineering (Aug. 1990) 384-88.

Poe, B.D. Jr., et al "An Efficient Semianalytic Reservoir Model for Complex Reservoirs," SPE 25455, Production Operations Symposium, Oklahoma City, OK, Mar. 21-23, 1993.

Spivey, J.P. & Frantz, J.H.: "History Matching Production Data Using Analytical Solutions for Linearly Varying Bottomhole Pressure," SPE 29167, East. Reg. Conf., Nov. 8-10, 1994.

Poe, B.D. Jr., et al "Prediction of Future Well Performance, Including Reservoir Depletion Effects," SPE 29465, Production Operations Symposium, Oklahoma City, OK, Apr. 2-4, 1995.

Spivey, J.P., and Semmelbeck, M.E.: "Forecasting Long-Term Gas Production of Dewatered Coal Seams and Fractured Gas Shales," SPE 29580, Rocky Mtn Reg Symp. Denver, Mar. 20-22, 1995.

Schubarth, et al "Reservoir Description Techniques Improves Completion Economics in Piceance Basin Mesaverde Project," SPE 39918, Rocky Mtn Reg. Symp. Denver, Apr. 5-8, 1998.

Poe, B.D. Jr. et al: "Production Data Analysis and Forecasting Using a Comprehensive Analysis System," SPE 52178 Mid-Cont. Oper. Symposium, Oklahoma City, Mar. 28-31, 1999.

Manrique, J.F.et al: "Production Optimization and Practical Reservoir Management of Coal Bed Methane Reservoirs," SPE 67315, Prod. Oper. Symp. Oklahoma City, Mar. 26-28, 2001.

Venkitaraman, A. et al: "A Comprehensive Approach to Completion Optimization," SPE 72386, Eastern Regional Meeting, Canton, Ohio, Oct. 17-19, 2001.

Larkin, S.D.et al: "Anal. of Completion and Stimulation Techniques in a S. Texas Field Utilizing Comprehensive Res. Eval.," SPE 93996, Prod. Op. Symp., Oklahoma, Apr. 17-19, 2005.

Osman, Mohammad E.: "Pressure analysis of a fractured well in multilayered reservoirs", Journal of Petroleum Science and Engineering, vol. 9, No. 1, Feb. 1993, pp. 49-66.

Frantz et al: "Using a Multilayer Reservoir Model to Describe a Hydraulically Fractured, Low-Permeability Shale Reservoir," SPE 24885, SPE ATCE, Washington, D.C. Oct. 4-7, 1992.

KAPPA Engineering, "KAPPA Software", brochure, Sep. 2006.

Poe, B.D. Jr., et al "Characterization of Commingled Reservoir Properties With Production Logs," SPE 102588, SPE Ann. Tech. Conf. and Exhibition, San Antonio, Sep. 24-27, 2006.

* cited by examiner

| Variable | True Value | Match using reconstructed single-layer rate history | Match using present invention | Units |
|---|---|---|---|---|
| Layer 1, permeability | 0.25 | 0.1226 | 0.25 | md |
| Layer 1, skin factor | 0 | -3.26 | $1.5\times10^{-5}$ | |
| Layer 1, drainage area | 10 | 9.92 | 10 | acres |
| Layer 2, permeability | 0.025 | 0.0473 | 0.0250001 | md |
| Layer 2, fracture half-length | 500 | 223 | 500 | ft |
| Layer 2, drainage area | 160 | 67.6 | 160.017 | acres |

METHOD FOR CHARACTERIZING AND FORECASTING PERFORMANCE OF WELLS IN MULTILAYER RESERVOIRS HAVING COMMINGLED PRODUCTION

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

FIG. 1, FIG. 2, FIG. 3, FIG. 4

1. Field of Invention

This invention relates to reservoir characterization and production forecasting for wells in low-permeability, multilayer gas reservoirs, specifically to an improved method for using production data and production log data to estimate layer properties, such as permeability, skin factor, drainage area, effective fracture half-length, fracture conductivity, etc., and for forecasting future performance of said wells.

2. Introduction

Many gas wells in the United States produce from low-permeability or tight gas reservoirs. These reservoirs present many challenges in drilling, completions, and reservoir evaluation. Because of the low permeability, tight gas wells must be completed by a stimulation treatment, such as massive hydraulic fracturing, to produce at economic rates. A typical fracture treatment, or frac job, represents a significant fraction of the total cost of drilling and completing the well. Thus, whether or not a frac job was successful is a question of great interest to the operator.

In conventional reservoirs, determining the success of a stimulation treatment would be performed by conducting and analyzing a buildup test or other type of pressure transient test. The rate at which a pressure transient moves through a reservoir is a function of the permeability, thus tight gas reservoirs require long test times to sample a significant portion of the reservoir. Therefore, pressure transient tests are of limited application for hydraulically fractured wells in low permeability reservoirs, where weeks or years are required to reach flow regimes of interest such as pseudoradial flow or boundary-dominated flow.

Instead, for single-layer tight gas reservoirs, fracture and reservoir properties are usually estimated by analyzing production data. Methods for such single-layer analysis include advanced decline curve analysis, type-curve matching, and automatic history matching. Properties of interest include the in-situ permeability to gas, the fracture half-length, the fracture conductivity, and the drainage area of the well. These properties are used in evaluating the success of a frac job, in deciding whether or not to perform a second frac job on a well, in optimizing future frac treatments, in forecasting future performance, and in estimating reserves.

Often, low-permeability gas reservoirs have multiple sands, zones, or layers that are produced together through a single tubing string, casing string, or flow string, as shown in FIG. 1. In some reservoirs, the productive section may span thousands of feet from the bottom of the lowest layer to the top of the uppermost layer.

In multilayer tight-gas reservoirs, wells are usually completed by performing multiple frac treatments or stages, with each frac stage covering only a couple of hundred feet of productive zone. Thus, as many as 20 or more separate frac stages may be required to complete a well in a multilayer tight gas reservoir. It is well known to those skilled in the art that production data alone does not provide enough information to estimate the properties of the individual layers in a well completed with multiple frac stages. Thus, the methods that are used to characterize single layer reservoirs are inadequate for estimating individual layer properties of multilayer reservoirs.

Some operators run production logs to measure wellbore flow rate and flowing wellbore pressure vs. depth for a multilayer reservoir at a single point in time, FIG. 2. Most operators who do run production logs use them for qualitative purposes, such as finding layers that are not contributing to flow, layers that produce large amounts of water, etc. However, production log data provides a great deal of information about the individual layers that is not provided by surface production data. Since the relative contribution of each layer to the total flow rate changes over time, multiple production logs may be run at different points in time to capture the changing layer contributions.

To date, the industry has had no accurate, fast, and efficient way of integrating production log data and production data to estimate individual layer properties. Because of the increasing use of commingled completions in low-permeability reservoirs, the need for such a method is both timely and of great economic importance.

DISCUSSION OF PRIOR ART

Single Layer Methods

Fetkovich (1980) proposed a method of using production data to estimate permeability and skin factor for a well producing at constant flowing bottomhole pressure from a single-layer, closed circular reservoir. Fraim and Wattenbarger (1987) presented plotting functions that allow decline type curves originally developed for slightly compressible liquids to be used for analyzing production from gas reservoirs. Other investigators have proposed methods for estimating properties of single-layer reservoirs by history matching production data, for example Watson, Lane, and Gatens (1990), Watson et al. (1990), and Spivey and Frantz (1994).

All of the methods discussed above are limited to estimating reservoir and completion properties for single-layer reservoirs. While data from multilayer reservoirs may be analyzed using these methods, the results give only the effective properties of an equivalent single-layer reservoir. Thus, the results cannot be used to make decisions regarding stimulation effectiveness for individual layers of a multilayer reservoir.

DISCUSSION OF PRIOR ART

Multilayer Methods

Kucuk and Ayestaran (U.S. Pat. No. 4,799,157) disclose a method of estimating permeability and skin factor for layers of a multilayer reservoir. In their method, a production logging device is first positioned above the top layer. The production rate is changed, and the pressure and downhole fluid flow rate are measured device as functions of time. The device is moved to a second position just above the second layer, the production rate is changed once more, and the pressure and downhole fluid flow rate are again measured as functions of time. This process is continued for each layer in the reservoir. The data are then analyzed by automatic history matching to estimate permeability and skin factor for each of the reservoir layers.

Christine Ehlig-Economides (U.S. Pat. No. 4,803,873, 1989), discloses a method of estimating properties of individual layers of a multilayer reservoir by producing the well at one constant rate, then changing the rate so as to produce at a different constant rate. Wellbore pressures and flow rates are measured with a production logging device at different points in time before and after the rate change. Ehlig-Economides later discloses an improved method (U.S. Pat. No. 5,247,829, 1993) that also relies on operator-initiated changes in the surface flow rate of a well. The improved method requires the determination of change in downhole pressure and flow rate at several discrete time intervals after the initiation of the test.

All of the methods proposed by Kucuck and Ehlig-Economides require the use of a specific test sequence under carefully controlled conditions. Thus, these methods are of limited application for hydraulically fractured wells in low permeability reservoirs where the long test times required are simply not realistic. Further, these methods use only bottomhole measurements of pressure and flow rate, ignoring surface measurements that may be obtained at significantly lower cost and that span a much longer period of time.

Stein and Carlson (U.S. Pat. No. 5,305,209, 1994) disclose a method of estimating individual layer properties for a reservoir producing under secondary recovery, i.e. injection of water or other fluid into the formation via at least one injection well to force oil to flow toward at least one production well. The inventors point out the "need for history matching on different rates," i.e. matching individually or in combination hydrocarbon production rates, fluid production rates, sum of hydrocarbon and fluid production rates, and fluid injection rates, in order to obtain a unique match. This method uses only surface production rate measurements. Further, the method has no application to low permeability gas reservoirs, in which secondary recovery methods are not feasible.

Guerillot and Roggero (U.S. Pat. No. 5,764,515 1998) disclose a method for forecasting future performance of a reservoir by automatic history matching production data. Their method incorporates prior knowledge regarding the unknown layer properties in the form of probability density functions (pdfs), thereby constraining the solution of the automatic history matching process. For low permeability gas reservoirs, the requisite pdfs simply are not available. Often, the best prior information available indicates that two different layers ought to have identical properties-yet one produces at a much higher rate than the other. Thus, the use of prior information as in the method of Guerillot and Roggero is of little or no benefit in tight gas wells.

DISCUSSION OF PRIOR ART

Analytical Simulation

Poe (U.S. Pat. No. 6,101,447, 2000) describes a method for forecasting future performance for multilayer reservoirs using a simulator that couples analytical rate-transient and pressure transient reservoir performance models with a tubing performance model. Although Poe's method does model multilayer reservoirs, the flowing wellbore pressure, $p_{wf}$, is assumed to be the same for all layers. This is a significant limitation in some low-permeability gas wells, where a single well may have 20 or more frac stages, producing from 50 or more sands varying in depth by several thousand feet. In this situation, the wellbore pressure to which each layer is exposed can potentially vary by hundreds of pounds per square inch. Thus, the pressure drop in the flow string between the layers should not be ignored, as is done in Poe's method.

The history matching module of Poe's invention uses analytical simulation with either specified pressure or specified rate inner boundary conditions. If the specified pressure option is used, then the user must provide the bottomhole pressures, and the cumulative production is history matched. If the specified rate option is used, the user provides flow rate data, and the bottomhole pressure is history matched. Bottomhole pressures are typically not available, so must be calculated from surface pressure and flow rate data. This approach is commonly used for single-layer reservoirs. Applying the method to multilayer reservoirs is more problematic, since contribution of each layer to the total well production, and therefore the wellbore flow rate between layers, is not known.

DISCUSSION OF PRIOR ART

Reconstruction of Single-Layer Production Histories

Poe (US 2002/0043370 A1, WO 02/23011 A1), proposed using production log data to select the best pressure traverse algorithm to allow the flowing sandface pressure for each layer to be calculated as a function of time. Poe also proposed using production log data to allocate production rates to the individual layers in a commingled multilayer reservoir system, thus allowing the individual layer production rate histories to be reconstructed. The individual production rate and pressure histories thus reconstructed are then analyzed using standard techniques for single-layer reservoirs.

Poe's method was applied to coalbed methane reservoirs in the paper by Manrique, Poe, and England (2001). Production logs were used to allocate production to each completed interval. The authors then used rate transient analysis and superposition-in-time to analyze the allocated production. Another application of Poe's method was described in a recent publication by Larkin et al. (2005). In this paper, the authors reconstructed the single-layer production histories using Poe's method, then used a variety of techniques, including rate transient analysis and production history matching, to analyze the resulting reconstructed single-layer production histories.

Despite having been used in a number of studies that have been reported in the literature, Poe's method has at least three significant disadvantages when applied to low permeability gas reservoirs.

First, Poe's method focuses on reconstructing the flowing sandface pressure history for each layer, giving much less attention to accurate reconstruction of the production rate histories of the individual layers. However, in low permeability reservoirs, the flowing sandface pressure for any given layer changes little with time, while the flow rate changes are often quite large.

Second, Poe's method relies on interpolation or extrapolation to reconstruct the individual production rate histories at times other than those at which production log data are available. Poe maintains that the "use of the identified pressure traverse model to generate the unmeasured wellbore flowing pressure is the only assumption required in the entire analysis." However, the choice of interpolation method to use in allocating production itself involves a further assumption. The appropriate interpolation method depends on the flow regime, which in general will be different for different layers and will change over time.

For example, for a layer with a high conductivity fracture in a closed circular reservoir produced at constant sandface pressure, production will first exhibit formation linear flow, followed by pseudoradial flow, and finally by boundary-dominated flow. During formation linear flow, the production rate will be approximately proportional to the inverse of the square root of time. During pseudoradial flow, the production rate will be approximately proportional to the inverse of the natural log of time, and during boundary-dominated flow, the production rate will decline exponentially. If all layers were exhibiting formation linear flow, a linear interpolation scheme with the reciprocal of the square root of time as the independent variable would be appropriate. Similarly, if all layers were exhibiting pseudoradial flow, a linear interpolation scheme based on the reciprocal of the logarithm of time as the independent variable would be appropriate. Since no single interpolation scheme is best for all flow regimes, selection of an interpolation scheme without a knowledge of the correct flow regime gives an inaccurate reconstructed rate history.

Third, as Poe points out, frequent production logs may be necessary to adequately sample the fractional flow rate contributions of the individual intervals when layer contributions are changing with time. By running frequent production logs, the limitations of the chosen interpolation scheme may be partially overcome. However, because of the expense, operators are reluctant to run more production logs than necessary.

To illustrate the need for frequent production logs, FIG. 3, FIG. 4A and FIG. 4B show a comparison of the application of Poe's allocation method to a synthetic data set for a two-layer reservoir with different layer properties. For this example, a two-layer model was constructed with one unstimulated layer having relatively high permeability of 0.25 md and limited areal extent, and a second layer with a long hydraulic fracture, a permeability of 0.025 md, and a large drainage area. The model was produced at constant flowing sandface pressure of 1,000 psia. Daily layer and well production rate and cumulative production where calculated for a one year period. Five synthetic production logs were computed, at 31, 91, 182, 274, and 365 days after the beginning of production.

For the first 30 days, the daily production rate was allocated to the two layers using linear extrapolation of the fractional flow rates from the first two production logs. For the remaining 335 days, daily production was allocated using linear interpolation of the fractional flow rates from the two production logs on either side of the time of interest.

The allocated layer production histories were then analyzed using automatic history matching with a single-layer model. The known constant flowing sandface pressure was used in the analysis to eliminate potential errors introduced in reconstruction of the sandface pressure history. To eliminate errors in model identification, the correct reservoir model was used for each layer. For Layer 1, matching parameters were permeability, skin factor, and drainage area; for Layer 2, matching parameters were permeability, fracture half-length, and drainage area. All other layer properties were the same as those used in the model to construct the synthetic data set.

Even though five production logs were used in the production allocation to reconstruct the single-layer production histories, analysis of the reconstructed single-layer production histories does not give the correct properties of the individual layers, as shown in FIG. 3. The only property that is acceptably close to the true value is the drainage area of Layer 1. If Poe's method were used for this well, Layer 1 would be incorrectly interpreted as having a high degree of stimulation when in fact the layer was unstimulated. Layer 2 would be incorrectly interpreted as having a fracture of less than half the true fracture length, and less than half the true drainage area. The permeability of Layer 1 would have been underestimated by a factor of two, while that of Layer 2 would have been overestimated by a factor of two. Thus, for this test case, the current invention provides much better estimates of layer properties than does the Poe method, with at least a 60% reduction in cost. This cost estimate is conservative, since it ignores the hidden costs associated with making poor decisions based on inaccurate data.

OBJECTS AND ADVANTAGES

Accordingly, several objects and advantages of the present invention are:

(a) to provide a method for computing the performance of a commingled reservoir system that rigorously accounts for pressure loss in tubing between layers as well as between the reservoir and the surface;

(b) to provide a method for computing the performance of a commingled reservoir system that is accurate, fast, and efficient, thereby making its use feasible for automatic history matching on a personal computer;

(c) to provide an improved method of history matching production and production log data from commingled wells with a multilayer predictive model that uses specified surface pressure instead of specified bottomhole pressure data;

(d) to provide improved estimates of reservoir and completion properties for individual layers of a multilayer reservoir;

(e) to provide estimates of layer properties without having to first reconstruct flowing sandface pressures and allocate production to individual layers;

(f) to provide estimates of layer properties that are not biased by choice of method of allocation of production to individual layers;

(g) to provide accurate estimates of layer properties without having to run a large number of production logs;

(h) to provide accurate estimates of layer properties from production data and production log data without requiring specialized test procedures or equipment; and (i) to provide accurate estimates of layer properties at reduced cost, thereby making their use cost effective in low productivity wells in low permeability gas reservoirs.

SUMMARY

The present invention concerns a method for forecasting performance for and characterizing the properties of a multilayer low permeability gas reservoir. The method includes a coupled well/reservoir predictive model that accounts for pressure drop between layers, allowing accurate, rigorous, and rapid forecasting of reservoir performance. The method provides estimates of individual layer properties such as in-situ permeability, skin factor, fracture half-length, fracture conductivity, drainage area, etc. by simultaneously history matching production data and production log data using the coupled well/reservoir predictive model.

DRAWINGS

Figures

Figure 1:
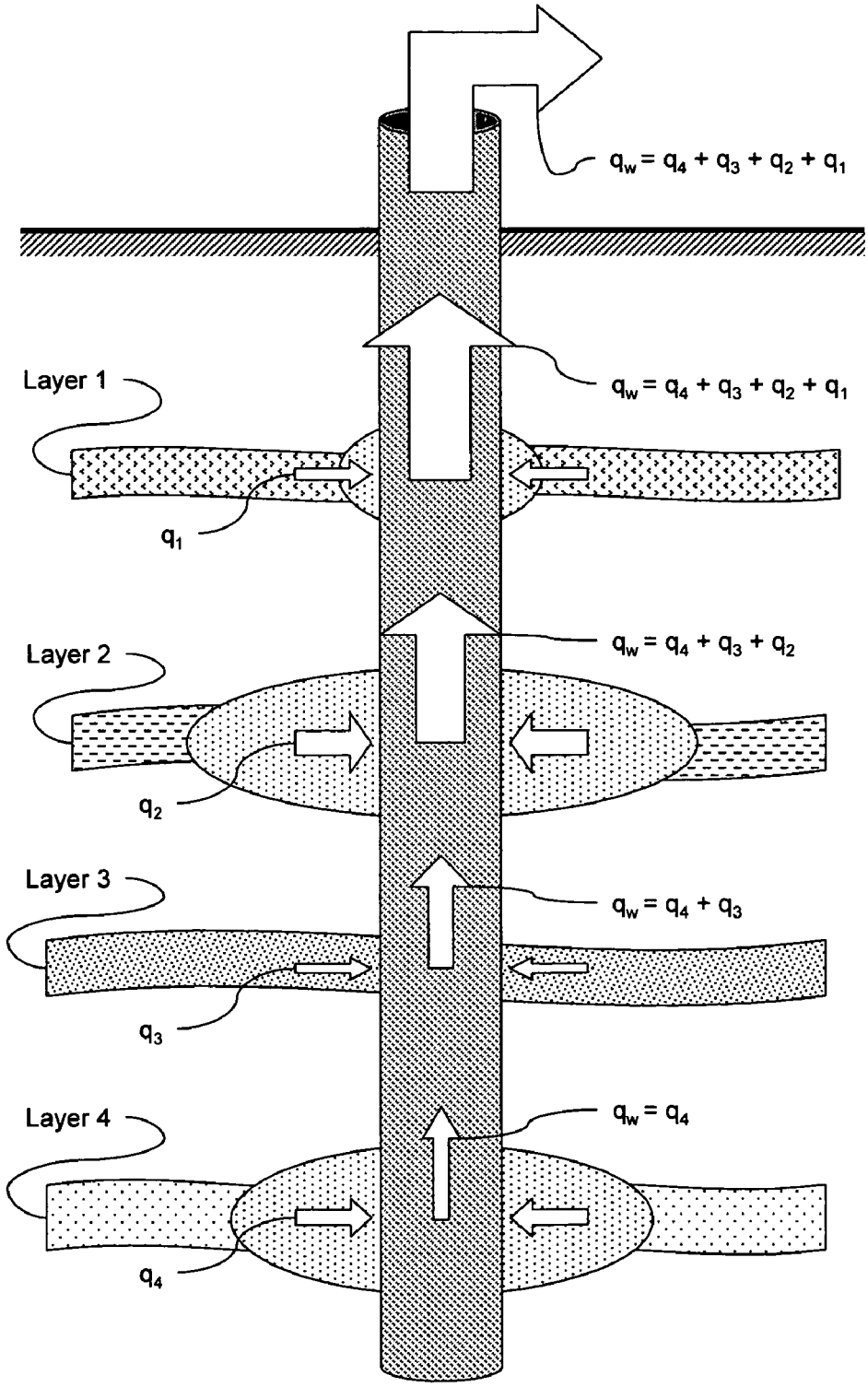
FIG. 1 shows a schematic of a well producing from a multilayer reservoir.
Figure 2:
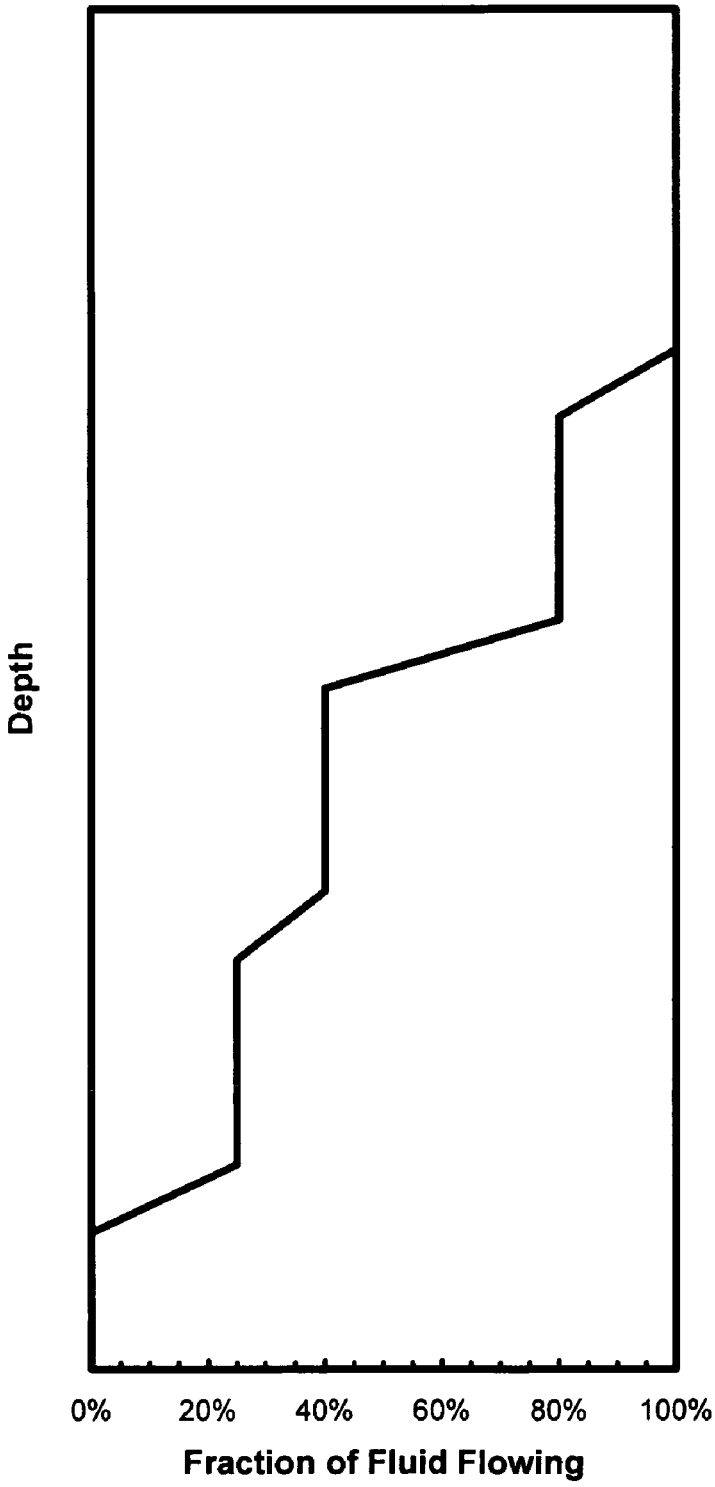
FIG. 2 shows a schematic production log response for the well shown in FIG. 1.
Figures 3, 4A:
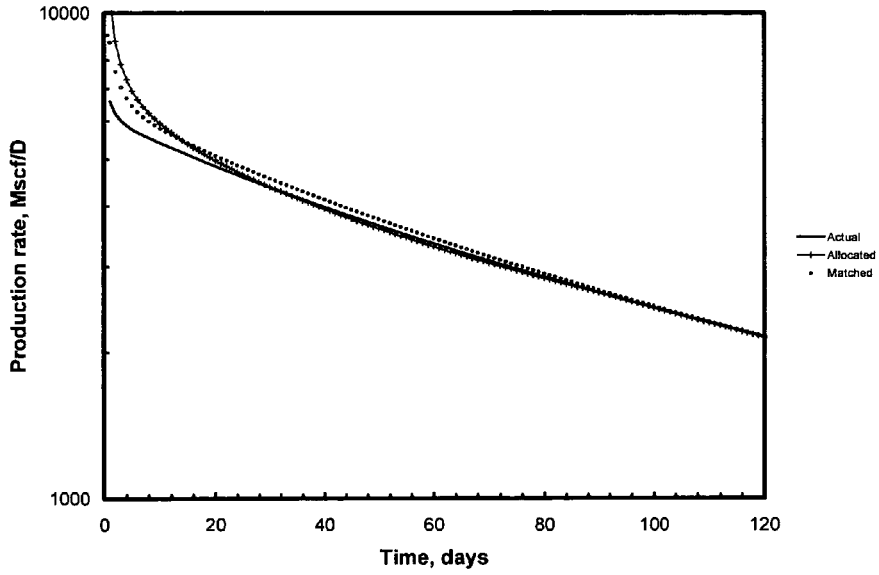
Fig. 4A (PRIOR ART)

FIG. 3 is a table showing the individual layer properties used to generate a synthetic test case (Test Case 1), the properties obtained by matching the individual layer production histories reconstructed using the prior art method recommended by Poe, with five production logs, and the properties obtained by matching the total well production data and only two production logs using the method of the present invention.

FIG. 4A shows the results for Layer 1 of Test Case 1 of the prior art method proposed by Poe. FIG. 4A shows the first 120 days of production for Layer 1, comparing the reconstructed layer rate and the matched single-layer rate to the true layer rate for Layer 1.

Figure 4B:
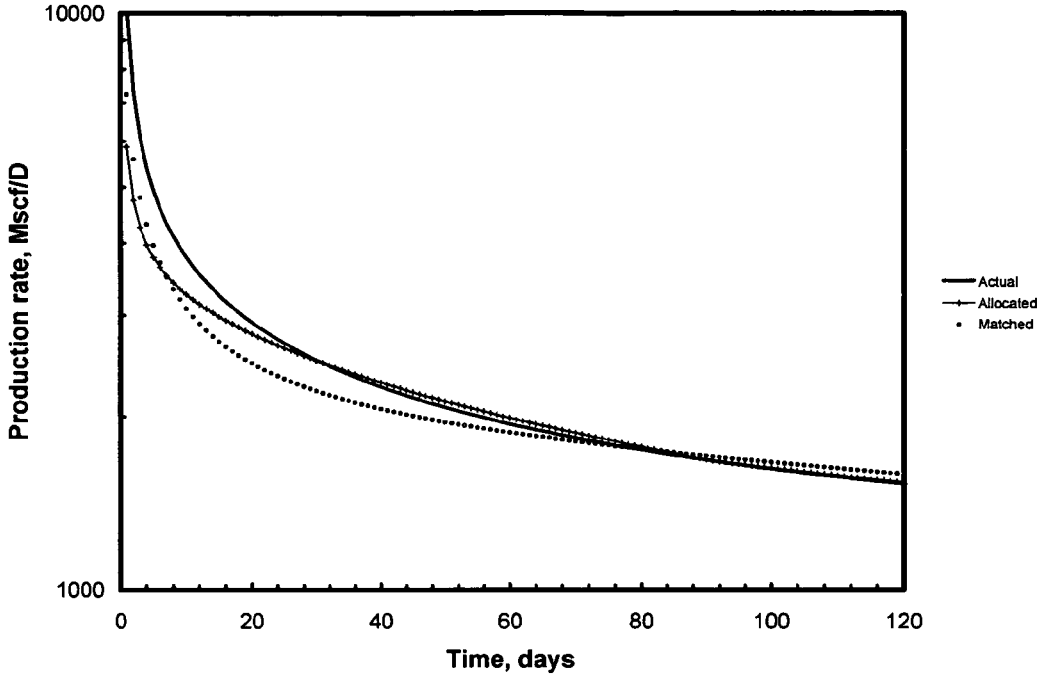
Fig. 4B (PRIOR ART)

FIG. 4B shows the results for Layer 2 of Test Case 1 of the prior art method proposed by Poe. FIG. 4B shows the first 120 days of production for Layer 2, comparing the reconstructed layer rate and the matched single-layer rate to the true layer rate for Layer 2.

Figure 5:
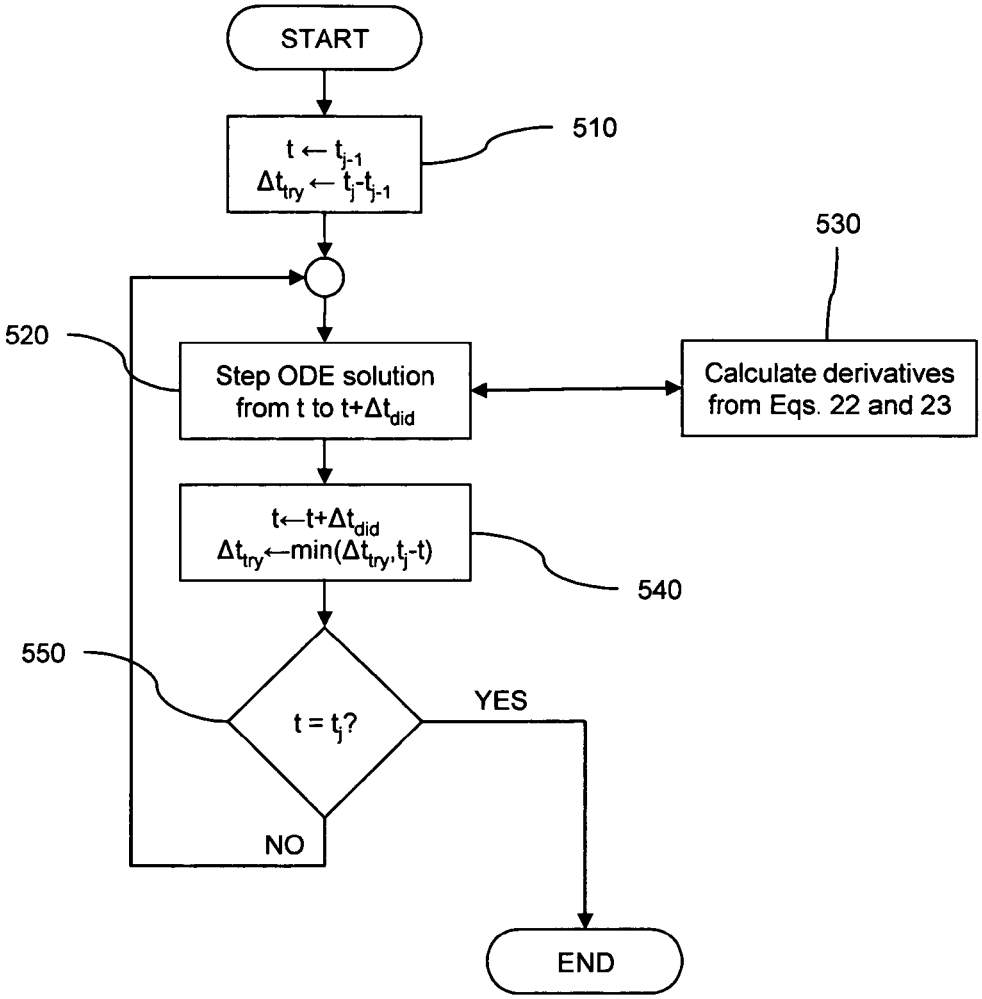

FIG. 5 shows a flow diagram for the constant pressure step option for the Single-Layer Predictive Model.

Figure 6:
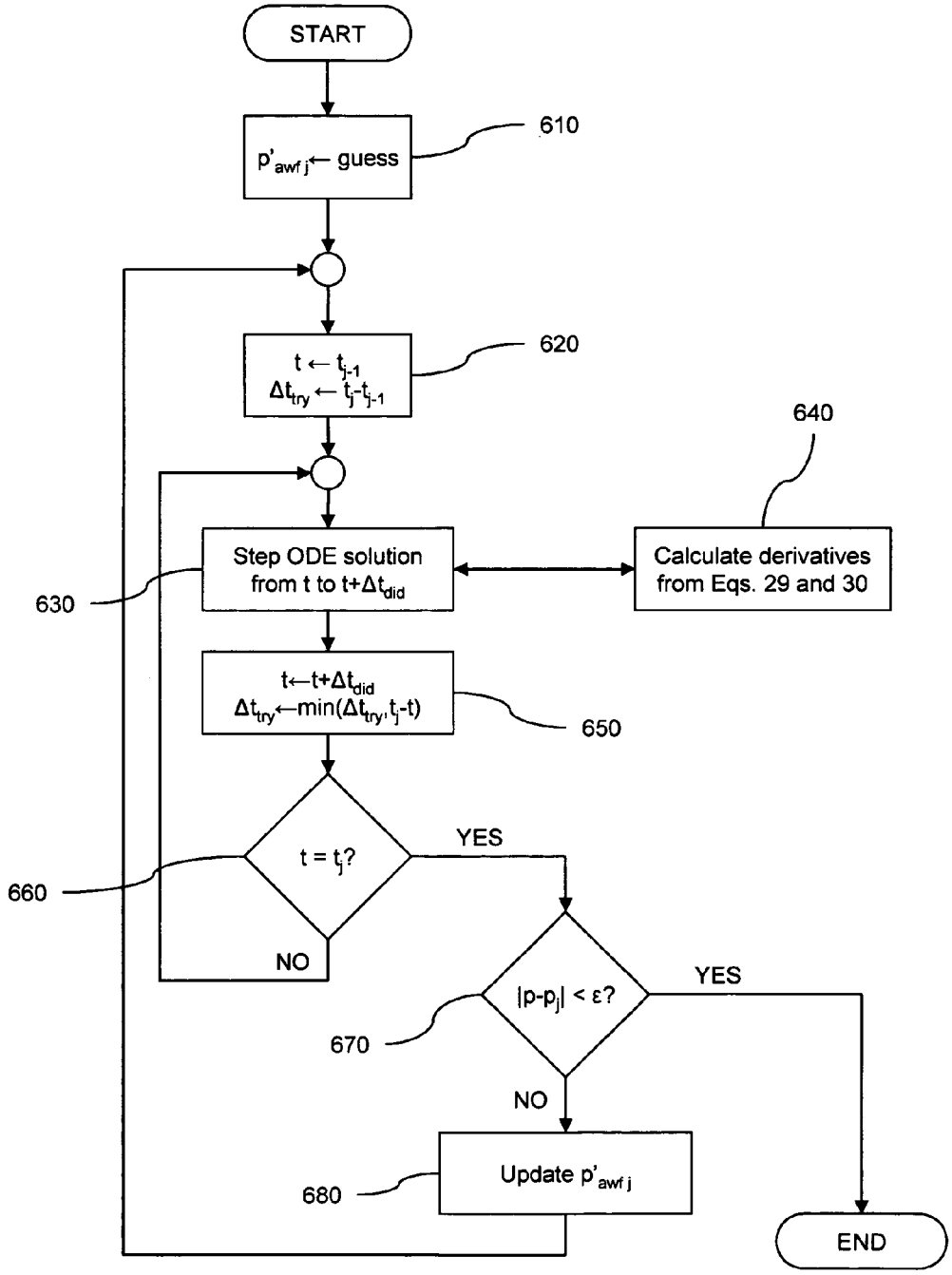

FIG. 6 shows a flow diagram for the piecewise linear pressure step option of the Single Layer Predictive Model.

Figure 7:
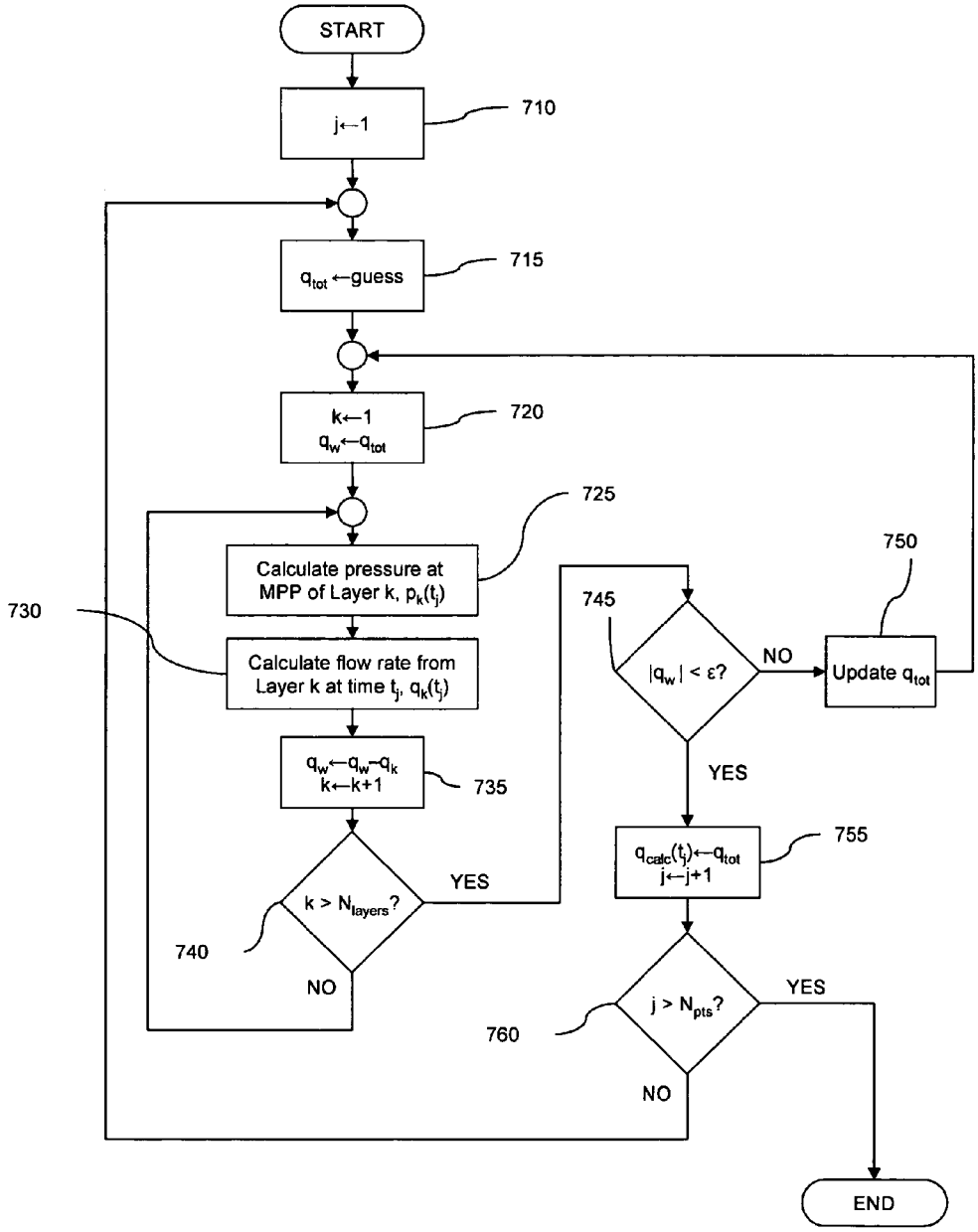

FIG. 7 shows a flow diagram of the preferred embodiment of the Multilayer Predictive Model for the commingled, multilayer reservoir system.

Figure 8:
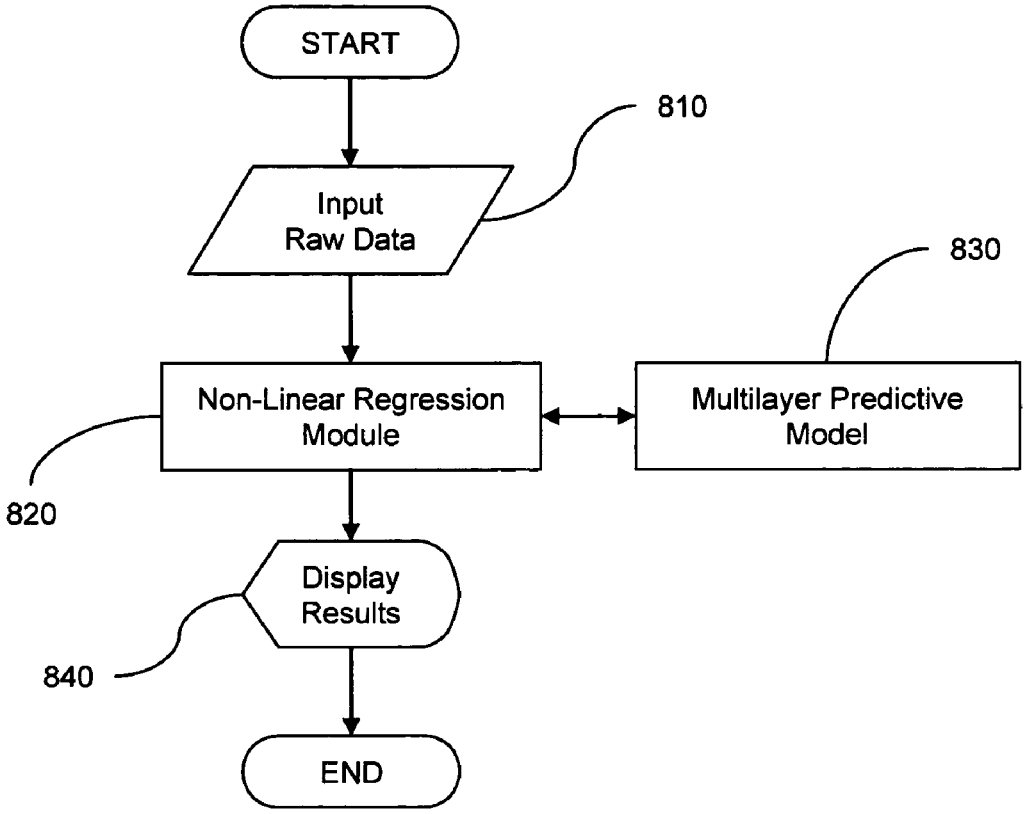

FIG. 8 shows a flow diagram of the invention as used in history-matching mode.

DETAILED DESCRIPTION

Preferred Embodiment

FIG. 5, FIG. 6, FIG. 7, FIG. 8

The preferred embodiment comprises two major components, a Multilayer Predictive Model and a Nonlinear Regression Module. The Multilayer Predictive Model, in turn, comprises three components: a Fluid Property Model; a Tubing Pressure Gradient Model; and a Single-Layer Predictive Model. The Multilayer Predictive Model may be used alone for forecasting future performance for a well in a reservoir with known properties. The Multilayer Predictive Model may also be used in combination with the Nonlinear Regression Module to history match production and production log data, thereby providing estimates of properties of the individual reservoir layers.

Fluid Property Model

The Fluid Property Model is used to calculate fluid properties for use by the Tubing Pressure Gradient Model and the Single-Layer Predictive Model.

In the preferred embodiment, the method outlined by Piper, McCain, and Corredor (1993) is used to calculate the pseudocritical temperature, $T_{pc}$, and pseudocritical pressure, $p_{pc}$, of the gas. The gas z-factor is then calculated using the equation of state proposed by Dranchuk and Abou-Kassem (1975). All other volumetric properties of the gas are calculated from the z-factor and fundamental relationships presented by McCain (1990). The gas viscosity is calculated using the method proposed by Lee, Gonzales, and Eakin (1966). Water properties are calculated using the method outlined by Spivey, McCain, and North (2004).

In modeling and analyzing flow of natural gas through porous media, it is convenient to introduce the pseudopressure transform to partially linearize the real gas flow equation. The pseudopressure is defined as $$p_p \equiv 2\int_{p'=0}^{p} \frac{p'\,dp'}{\mu(p')Z(p')}, \tag{1}$$

which may also be written as a first-order differential equation:

$$\frac{dp_p}{dp} \equiv \frac{2p}{\mu(p)Z(p)} \tag{2}$$

In the preferred embodiment, the pseudopressure is calculated using the Bulirsch-Stoer method, as described by Press, et al. (1992), pp. 724-732, to integrate the first order differential equation defined by Eq. 2. Because the units of pseudopressure are inconvenient, a normalized pseudopressure, referred to as the adjusted pressure, is defined as $$p_a = \frac{\mu_i Z_i}{2} p_p, \tag{3}$$

where $\mu_i$ and $Z_i$ are the viscosity and z-factor, respectively, evaluated at the initial reservoir pressure, $p_i$. Because the initial pressures of the various layers will most likely be different, a different normalization constant is required for each layer. This does not pose a problem, since the adjusted pressure so computed is used only within the Single Layer Predictive Model specific to the respective layer.

Tubing Pressure Gradient Model

The Tubing Pressure Gradient Model is used to calculate the pressure at the midpoint of perforations of each reservoir layer, given the gas properties, the wellbore configuration, the temperature gradient, the pressure at the wellhead or midpoint of perforations of the previous layer, and the gas flow rate. In the preferred embodiment, the Tubing Pressure Gradient Model is evaluated by numerical integration of the equation describing single-phase flow of natural gas through a vertical pipe, given as $$\frac{dp}{dL} = \frac{-\frac{\rho}{144}\left[\left(\frac{u^2}{2\alpha g_c}\right)\left(\frac{1}{B_g}\frac{\partial B_g}{\partial T}\Big|_T\right)\frac{dT}{dz}\cos\theta + \frac{g\cos\theta}{g_c} + \frac{2fu^2}{g_c D}\right]}{1-\left(\frac{\rho}{144}\right)\left(\frac{u^2 c_g}{2\alpha g_c}\right)}, \tag{4}$$

where $\alpha$ is a correction factor taken to be 0.5 for laminar flow and 1.0 for fully turbulent flow. In the preferred embodiment, $\alpha$ is assumed to be 1.0.

The friction factor f in Eq. 4 is the Fanning friction factor, and may be calculated by the well-known Colebrook-White equation.

The gas velocity, u, is calculated from the flow rate q using Eq. 5:

$$u = \frac{1}{86{,}400}\frac{qB_g}{A} \tag{5}$$

Several of the terms in Eq. 4 are temperature and pressure dependent, so it is convenient to formulate the problem as a system of first order ordinary differential equations, with distance along the wellbore, L, as the independent variable, and temperature and pressure as the dependent variables. The temperature gradient is given by Eq. 6:

$$\frac{dT}{dL} = \frac{dT}{dz}\cos\theta \tag{6}$$

In the preferred embodiment of Tubing Pressure Gradient Model, the Bulirsch-Stoer method is used to integrate the set of first order differential equations defined by Eqs. 4 and 6.

Single-Layer Predictive Model

The Single-Layer Predictive Model is used to calculate the flow rate from a single layer, given the layer properties and the flowing sandface pressure history $p(t_j)$ or $p_j$. In the preferred embodiment, the Single-Layer Predictive Model is evaluated through the use of dimensionless rate, $q_D$, and cumulative production, $Q_D$, solutions to the diffusivity equation for a well in a reservoir with a constant pressure inner boundary, as discussed by Fraim and Wattenbarger (1987) and Spivey and Semmelbeck (1995).

In the preferred embodiment, the operator may choose from a number of different well, reservoir, and outer boundary models for each layer. Well models include fully penetrating vertical well, hydraulically fractured well, and horizontal well models. Reservoir models include homogeneous, pseudosteady state dual porosity, and transient dual porosity models. Outer boundary models include infinite reservoir, closed circular reservoir, closed rectangular reservoir, infinite radial composite reservoir, and finite radial composite reservoir models. As will be known to those skilled in the art, dimensionless solutions for these and other reservoir models have been widely reported in the literature.

The operator may also choose either the coalbed methane option or the naturally fractured shale option, in which case the material balance equation is modified to include gas adsorbed on the matrix in addition to the gas stored in the conventional pore system. The necessary modifications are discussed Spivey and Semmelbeck (1995).

The preferred embodiment of the Single-Layer Predictive Model has two options for modeling the flowing sandface pressure. The flowing sandface pressure may be modeled as a series of constant pressure steps, FIG. 5, or as a continuous, piecewise linear function as described by Spivey and Frantz (1994), FIG. 6. This second option has the advantage of requiring fewer points to approximate a typical flowing pressure history. This advantage is offset, however, by the fact that an extra iteration loop is required to compute the production rate vs. time.

The adjusted time is defined as $$t_a \equiv \phi_i\mu_i c_{ti}\int_0^t \frac{dt}{\phi(\bar{p})\mu(\bar{p})c_t(\bar{p})}, \tag{7}$$

where $\bar{p}$ is the average reservoir pressure. The average reservoir pressure may be calculated from the reservoir properties at initial pressure $p_i$ and the cumulative production $G_p$ by solving Eq. 8 for $\bar{p}$:

$$\frac{7758A\phi(\bar{p})h(1-S_w(\bar{p}))}{B_g(\bar{p})} = \frac{7758A\phi_i h(1-S_{wi})}{B_{gi}} - G_p \tag{8}$$

Eq. 8 may be rearranged by writing the original gas in place as G, and defining the ratio of gas remaining to original gas in place as $R_{rf}$, $$R_{rf}(\bar{p}) \equiv \frac{\dfrac{7758A\phi(\bar{p})h(1-S_w(\bar{p}))}{B_g(\bar{p})}}{\dfrac{7758A\phi_i h(1-S_{wi})}{B_{gi}}} \tag{9}$$

Substitution of Eq. 9 into Eq. 8 gives $$R_{rf}(\bar{p}) = 1 - \frac{G_p}{G} \tag{10}$$

Because the definition of the adjusted time, Eq. 7, includes the average reservoir pressure, which is itself a function of the cumulative production, an iterative procedure must be used to evaluate the adjusted time.

The adjusted cumulative production is defined as $$G_{pa} \equiv \phi_i\mu_i c_{ti}\int_0^t \frac{q\,dt}{\phi(\bar{p})\mu(\bar{p})c_t(\bar{p})} \tag{11}$$

The dimensionless adjusted time, flow rate, and adjusted cumulative production are defined by $$t_{aD} = C_t t_a \tag{12}$$

$$q_D = C_q q \tag{13}$$

and $$Q_D = C_q C_t G_{pa} \tag{14}$$

The coefficient C, in Eqs. 12 and 14 is defined for field units as $$C_t \equiv \frac{0.00633k}{\phi_i\mu_i c_{ti} d^2} \tag{15}$$

where d is a characteristic length of the system in question. For radial flow to a vertical well, d is the wellbore radius, $r_w$. For a hydraulically fractured well, d is the fracture half-length, $L_f$.

The coefficient $C_q$ in Eqs. 13 and 14 is defined for field units as $$C_q \equiv \frac{141.2\mu_i B_i}{kh} \tag{16}$$

Constant Pressure Step Option

For the constant pressure step option, the pressure history is given by $$p_{wf}(t) = \begin{cases} p_i, & t \le 0 \\ p_j, & t_{j-1} < t \le t_j \end{cases} \tag{17}$$

Adjusted pressures $p_{awfj}$ are determined directly from the pressures $p_j$. The adjusted times $t_{aj}$ corresponding to times $t_j$ will be determined during execution of the Single Layer Predictive Model.

For a given adjusted time $t_a$, the flow rate q is calculated as $$q(t_a) = \frac{1}{C_q}\sum_{j=1}^{N}(p_{aj} - p_{aj-1})q_D(t_{aD} - t_{aDj-1}) \tag{18}$$

The adjusted cumulative production $G_{pa}$ at time t is calculated from the adjusted time $t_a$ as $$G_{pa}(t) = \frac{1}{C_q C_t}\sum_{j=1}^{N}(p_{aj} - p_{aj-1})Q_D(t_{aD} - t_{aDj-1}) \tag{19}$$

Eqs. 7 through 18 may be cast as a set of first order ordinary differential equations, with time, t, as the independent variable, and the adjusted time, $t_a$, and the difference between adjusted cumulative production, $G_{pa}$, and the actual cumulative production, $G_p$, as dependent variables. Initial conditions are:

$$t_a(0)=0 \tag{20}$$

and $$G_p(0)-G_{pa}(0)=0 \tag{21}$$

The differential equations are:

$$\frac{dt_a}{dt} = \frac{\phi_i\mu_i c_{ti}}{\phi(\overline{p})\mu(\overline{p})c_t(\overline{p})} \tag{22}$$

$$\frac{d(G_p - G_{pa})}{dt} = \left(1 - \frac{\phi_i\mu_i c_{ti}}{\phi(\overline{p})\mu(\overline{p})c_t(\overline{p})}\right)q(t) \tag{23}$$

In the preferred embodiment of the Single-Layer Predictive Model, the Bulirsch-Stoer method is used to integrate the set of first order differential equations defined by Eqs. 22 and 23.

Piecewise Linear Pressure Step Option

For the piecewise linear pressure step option, the adjusted pressure history is given as a piecewise linear function of adjusted time:

$$p_{awf}(t) = \begin{cases} p_{ai}, & t \le 0 \\ p_{aj} + \left(\frac{p_{aj} - p_{aj-1}}{t_{aj} - t_{aj-1}}\right)(t_a - t_{aj}), & t_j < t \le t_{j+1} \end{cases} \tag{24}$$

Now, both the adjusted time $t_a$ and the slope of $p_{wf}$ with respect to $t_a$ must be determined by iteration.

The flow rate q at time t is calculated from the adjusted time $t_a$ as $$q(t) = \frac{1}{C_q C_t}\sum_{j=1}^{N}(p'_{aj} - p'_{aj-1})Q_D(t_{aD} - t_{aDj-1}), \tag{25}$$

where the slope $p'_{aj}$ is defined as $$p'_{aj} = \frac{p_{aj} - p_{aj-1}}{t_{aj} - t_{aj-1}} \tag{26}$$

Note that, for the linearly varying pressure, the dimensionless cumulative production for a unit step pressure change, $Q_D$, is used in the superposition equation for production rate, Eq. 25.

As with the constant pressure step option, Eqs. 7, 24, and 25 may be cast as a set of first order ordinary differential equations, with time, t, as the independent variable. The dependent variables are the adjusted time, $t_a$, and cumulative production, $G_p$. Initial conditions are:

$$t_a(0)=0 \tag{27}$$

and $$G_p(0) \tag{28}$$

The differential equations are:

$$\frac{dt_a}{dt} = \frac{\phi_i\mu_i c_{ti}}{\phi(\overline{p})\mu(\overline{p})c_t(\overline{p})} \tag{29}$$

$$\frac{dG_p}{dt} = q(t) \tag{30}$$

In the preferred embodiment of the Single-Layer Predictive Model, the Bulirsch-Stoer method is used to integrate the set of first order differential equations defined by Eqs. 29 and 30. Since the derivative given in Eq. 26 depends on the adjusted time at the end of the time step, it must be determined iteratively. The present embodiment uses two steps of fixed-point iteration followed by further iterations with the well-known secant method.

Speed considerations

To speed up execution of the Single-Layer Predictive Model, the desired fluid properties are not calculated directly with the Fluid Property Model. Instead, upon initialization for each layer, the Fluid Property Model is used to construct cubic spline interpolation tables of adjusted pressure, $p_a$, as a function of pressure and the reciprocal of the porosity-viscosity-compressibility product, $1/\phi\mu c_t$, and the average reservoir pressure, $\overline{p}$, as functions of fraction of fluid remaining, $R_{rf}$. The cubic spline interpolation tables are then used to calculate the appropriate fluid properties as needed during execution of the Single Layer Predictive Model. Constructing the spline for $\bar{p}$ as a function of $R_{rf}$ allows Eq. 10 to be solved for $\bar{p}$ by a simple spline evaluation rather than requiring an iterative solution.

Similarly, cubic splines are used to evaluate the constant pressure solutions $q_D$ and $Q_D$. I presently prefer to build the spline tables using dimensionless time $t_D$ as the independent variable, rather than the logarithm of dimensionless time, since evaluating the logarithm is one of the most time-consuming operations built into the floating point processor. The spline table is built to cover a wide enough range of dimensionless times so that simple asymptotic solutions may be used to evaluate $q_D$ and $Q_D$ for dimensionless times outside the range of the table.

Multilayer Predictive Model

The Multilayer Predictive Model couples a Single Layer Predictive Model for each of the reservoir layers with the Tubing Pressure Gradient Model. The Multilayer Predictive Model thus provides a comprehensive predictive model for calculating the production rate, cumulative production, flowing bottomhole pressure, and average reservoir pressure vs. time for each of the individual layers as well as the total well production rate and cumulative production vs. time, given the reservoir properties of each of the reservoir layers.

The Multilayer Predictive Model offers two options for approximating the flowing wellhead pressure history. In the first option, the flowing wellhead pressure vs. time is approximated by a series of constant pressure steps, designated as $p(t_j)$ or $p_j$. When this option is selected, the flowing sandface pressure for the Single-Layer Predictive Model is also approximated by a series of constant pressure steps, the values of which will be determined during execution of the Multilayer Predictive Model. In the second option, the flowing wellhead pressure is approximated by a continuous, piecewise-linear function of time. In this case, the flowing sandface adjusted pressure used in the Single-Layer Predictive Model is approximated by a continuous, piecewise-linear function of adjusted time.

The Multilayer Predictive Model has three nested loops, as shown in FIG. 7. The outermost loop steps through time, calculating the flowing sandface pressure, production rate, cumulative production, and average reservoir pressure for each layer and the total well production rate and cumulative production at the end of each time step. The middle loop uses an iterative root finding technique to solve for the surface flow rate $q_{tot}$ at the end of the time step, $t_j$. The innermost loop steps through the individual layers of the reservoir model, solving for the wellbore flow rate, flowing sandface pressure, and production rate for each layer, given an assumed surface flow rate, $q_{tot}$. If the assumed surface flow rate $q_{tot}$ is correct, the algebraic sum of the individual layer rates will be equal to the assumed surface flow rate.

Nonlinear Regression Module

The Nonlinear Regression Module is used to estimate the unknown properties of each layer by finding the values of those properties that minimize an objective function such as that defined by $$F = \sum_{j=1}^{N_{prod}} \left( \frac{G_{pcalc\,j} - G_{pobs\,j}}{\sigma_{G_p j}} \right)^2 + \sum_{j=1}^{N_{pl}} \left[ \sum_{k=1}^{N_{lay}} \left( \frac{q_{calc\,j,k} - q_{obs\,j,k}}{\sigma_{q\,j,k}} \right)^2 \right] \quad (31)$$

In Eq. 31, the variable $\sigma_{G_p j}$ is the estimated uncertainty in the measurement of the $j^{th}$ cumulative production data point and $\sigma_{qj,k}$ is the estimated uncertainty in the measurement of the $k^{th}$ production log data point for the $j^{th}$ production log. Unfortunately, these estimated uncertainties are normally not available.

In the preferred embodiment, the uncertainty in the cumulative production measurement is replaced by the total historical cumulative production to date, $G_{p\ tot}$, and the uncertainty in the production log rate measurement is replaced by the total production rate at the time the $j^{th}$ production log was run, $q_{tot\ j}$. Further, coefficients A and B are introduced to allow the operator to control the relative importance of the two terms in the sum, as shown in Eq. 32:

$$F = A \sum_{j=1}^{N_{prod}} \left( \frac{G_{pcalc\,j} - G_{pobs\,j}}{G_{ptot}} \right)^2 + B \sum_{j=1}^{N_{pl}} \left[ \sum_{k=1}^{N_{lay}} \left( \frac{q_{calc\,j,k} - q_{obs\,j,k}}{q_{tot\,j}} \right)^2 \right] \quad (32)$$

As alternatives to the objective function defined in Eq. 32, the operator may optionally choose to match on the incremental production between $t_{j-1}$ and $t_j$, in which case the first term of Eq. 32 is modified, as shown in Eq. 33.

$$F = A \sum_{j=1}^{N_{prod}} \left( \frac{\Delta G_{pcalc\,j} - \Delta G_{pobs\,j}}{G_{ptot}} \right)^2 + B \sum_{j=1}^{N_{pl}} \left[ \sum_{k=1}^{N_{lay}} \left( \frac{q_{calc\,j,k} - q_{obs\,j,k}}{q_{tot\,j}} \right)^2 \right] \quad (33)$$

The operator may also choose to match on the running total rate, for each layer, $q_{rt}$, defined as the sum of the rates of all layers from the bottom of the well to the layer of interest. In this case, the second term of Eq. 32 is modified as shown in Eq. 34:

$$F = A \sum_{j=1}^{N_{prod}} \left( \frac{G_{pcalc\,j} - G_{pobs\,j}}{G_{ptot}} \right)^2 + B \sum_{j=1}^{N_{pl}} \left[ \sum_{k=1}^{N_{lay}} \left( \frac{q_{rtcalc\,j,k} - q_{rtobs\,j,k}}{q_{tot\,j}} \right)^2 \right] \quad (34)$$

Either or both of the modified terms in Eqs. 33 and 34 may be substituted for the corresponding terms in Eq. 32.

In the preferred embodiment, the Levenberg-Marquardt method with linear constraints is used to minimize the objective function with respect to the unknown layer parameters. The Levenberg-Marquardt method is well-known to those skilled in the art, and is described at length in a number of references, including Gill, Murray, and Wright (1981), and Press, et al. (1992), pp. 683-688.

OPERATION

Preferred Embodiment

FIG. 5, FIG. 6, FIG. 7, FIG. 8

Single-Layer Predictive Model

FIG. 5 shows a flowchart of the operation of the constant pressure step option of the Single-Layer Predictive Model during calculation of the time step from $t_{j-1}$ to $t_j$. First, the integration time variable, t, is initialized to the start time for the time step, $t_{j-1}$, and the time increment to attempt, $\Delta t_{try}$, is set to the length of the time step, $t_j$-$t_{j-1}$, 510. The Bulirsch-Stoer algorithm is used to advance the solution through time, 520. Since the Bulirsch-Stoer algorithm is an adaptive step size algorithm, the time increment actually taken, $\Delta t_{did}$, may be smaller than the time increment attempted, $\Delta t_{try}$. The Bulirsch-Stoer algorithm calls a routine to calculate the derivatives in Eqs. 22 and 23 as needed, 530. The integration time variable t is incremented by $\Delta t_{did}$, and the time increment to attempt, $\Delta t_{try}$, is updated, 540. Finally, steps 520 through 540 are repeated until the end of the time step $t_j$ is reached, 550.

FIG. 6 shows a flowchart of the operation of the piecewise linear pressure step option of the Single Layer Predictive Model during calculation of the time step from $t_{j-1}$ to $t_j$. First, the derivative of adjusted pressure with respect to adjusted time is estimated 610. Next, the integration time variable, t, is initialized to the start time for the time step, $t_{j-1}$, and the time increment to attempt, $\Delta t_{try}$, is set to the length of the time step, $t_j$-$t_{j-1}$, 620. The Bulirsch-Stoer algorithm is used to advance the solution through time, 630. The Bulirsch-Stoer algorithm calls a routine to calculate the derivatives in Eqs. 29 and 30 as needed, 640. The integration time variable t is incremented by $\Delta t_{did}$, and the time increment to attempt, $\Delta t_{try}$, is updated, 650. Steps 630 through 650 are repeated until the end of the time step $t_j$ is reached, 660. The calculated wellbore pressure at time $t_j$ is compared to the input value $p_j$, 670. If the pressures are not within an predetermined tolerance, $\epsilon$, the estimate of the derivative $dp_{avf}/d_t$ is updated 680, and steps 620 through 670 are repeated until the pressures lie within the desired tolerance.

Multilayer Predictive Model

FIG. 7 shows a flowchart of the operation of the preferred embodiment of the Multilayer Predictive Model. Evaluation of the Multilayer Predictive Model begins with initialization of a time step index j, 710. An initial guess for the total well rate, $q_{tot}$, at time $t_j$ is then made, 715. For low permeability reservoirs, where production rates are low, and thus the frictional pressure losses are also low, the initial guess may be taken to be zero. In the preferred embodiment, the solution is bracketed by calculating an upper bound on the flow rate. The desired upper bound, given by the expression $$u = \sqrt{\left(\frac{144}{\rho}\right)\left(\frac{2ag_c}{c_g}\right)}, \tag{35}$$

is obtained by setting the denominator of Eq. 4 equal to zero and solving for the velocity u. In the present embodiment, the maximum velocity given by Eq. 35 is multiplied by 0.99. The corresponding maximum surface flow rate is calculated from the expression $$q = \frac{A}{B_g}u \tag{36}$$

Next, the layer index, k, is initialized, and the wellbore flow rate, $q_w$, is set to the total well rate, $q_{tot}$, 720.

In the next step, 725, the Tubing Pressure Gradient Model is used to calculate the pressure at midpoint of perforations for Layer k, $p_k$. For Layer 1, the pressure drop is calculated from the wellhead to the midpoint of perforations for Layer 1. For subsequent layers, the pressure drop is calculated from Layer k−1 to Layer k.

The Single Layer Predictive Model is then used to calculate the production rate for Layer k, $q_k$, at time $t_j$, 730. The wellbore flow rate, $q_w$, is reduced by the production rate, $q_k$, from Layer k and the layer index is incremented, 735. Steps 725 through 735 are repeated until the sandface pressure and production rate have been calculated for all layers, 740.

The wellbore flow rate $q_w$ remainder after all layer rates have been calculated is the difference between the assumed total surface flow rate, $q_{tot}$, and the sum of the layer flow rates, $\Sigma q_k$. If the remainder differs from zero by more than a specified tolerance, $\epsilon$, 745, the total surface flow rate estimate $q_{tot}$ is updated using a non-linear root-finding method such as the secant method, 750, and steps 720 through 745 are repeated.

The total surface flow rate $q_{tot}$ is stored as the total well rate at time $t_j$, $q_{calc}(t_j)$, and the time step index j is incremented, 755. Steps 715 through 755 are repeated until all time steps have been processed, 760.

Nonlinear Regression Module

FIG. 8 shows flowchart giving an overview of the operation of the preferred embodiment as used for history matching. First, raw data, comprising a description of the reservoir model, initial estimates of its unknown parameters, production history data, and production log data, are input 810. The Nonlinear Regression Module 820 calls the Multilayer Predictive Model 830 as necessary to generate a synthetic production history and synthetic production log data to compare with the observed production history and observed production log data. If the estimates of the unknown parameters are close to the true values, the simulated or synthetic data should be close to the corresponding observed data. The Nonlinear Regression Module 820 then iterates to find the minimum of the objective function, Eq. 32. Finally, the results are displayed 840.

DESCRIPTION

Alternative Embodiment

Fluid Property Model

Alternative embodiments of the invention would include, but are not limited to, any combination of the following modifications to the Fluid Property Model:

1) Use of a different method of calculating pseudocritical properties of natural gases from gas specific gravity.
2) Use of a different method of calculating pseudocritical properties of natural gases from gas composition.
3) Use of a different method of calculating z-factors.
4) Use of a different gas viscosity correlation.
5) Use of a different method of evaluating the defining integral for pseudopressure.

Tubing Pressure Gradient Model

Alternative embodiments of the invention would include, but are not limited to, any combination of the following modifications to the Tubing Pressure Gradient Model:

1) Use of a different method of integrating the flow equation, such as one of the well-known Runga-Kutta methods.
2) Use of a different method for calculating pressure drop in tubing, such as the well-known average temperature and compressibility method as described in *Theory and Practice of the Testing of Gas Wells*, (1975), pp. B-18-B-19.
3) Pre-calculation and use of two-dimensional tables for calculating pressure drop in the tubing.

One extremely popular method, the Cullendar and Smith method (1957) should not be used for the Tubing Pressure Gradient Model. This method was proposed as a hand calculation method for improved accuracy over the average temperature and pressure method. Unfortunately, the Cullendar and Smith method has a singularity in its formulation that prevents its use for injection cases where gas is flowing downward, i.e. the frictional and hydrostatic components of the pressure drop act in opposite directions. This phenomenon is discussed by Young (1967). To handle the possibility of crossflow from one layer into another, the Tubing Pressure Gradient Model must be able to handle downward flow as well as upward flow, thus the Cullendar and Smith method should not be used.

Single-Layer Predictive Model

Further alternative embodiments of the invention would include, but are not limited to, any of the following modifications to the Single-Layer Predictive Model:

1) Use of an analytical model formulated in terms of pseudopressure, pressure-squared, or pressure instead of adjusted pressure.
2) Use of a Laplace Transform Finite Difference dimensionless rate solution, as described by Moridis et al. (1994).
3) Incorporation of a term representing the pressure drop across the completion caused by non-Darcy flow, Eq. 37, $$p_{a,sf} - p_{a,mpp} = \frac{B_{gi}\mu_{gi}}{0.00708kh} D|q|q, \tag{37}$$

where D is a non-Darcy flow coefficient that depends on the geometry of the completion. For a fully penetrating well with an open-hole completion, D may be estimated from $$D = \frac{2.715\times10^{-12}\beta k_g M p_{sc}}{h\mu_g(p_{wf})r_w T_{sc}},$$

where β is the turbulence parameter, a property of the reservoir rock.

4) Use of a pseudosteady state inflow performance model such as the well-known gas deliverability equation, Eq. 38, $$q = C(\overline{p}^2 - p_{wf}^2)^n \tag{38}$$

or the Houpeurt equation, Eq. 39, $$\overline{p}^2 - p_{wf}^2 = aq + bq^2 \tag{39}$$

combined with a material balance equation.

5) Substitution of a finite-difference or finite-element numerical reservoir simulation model for the analytical model.

Multilayer Predictive Model

Alternative embodiments of the invention would include, but are not limited to, any of the following modifications to the Multilayer Predictive Model:

1) Modification of the calculation procedure to assume a sandface pressure for the bottom-most layer and calculate the production rate for that layer. Calculation would then proceed from the bottom to the top of the well, calculating first the sandface pressure, then the production rate, for each layer in turn. The Multilayer Predictive model would then iterate to find the bottomhole pressure that results in a calculated surface pressure equal to the known surface pressure.
2) Modification of the calculation procedure to approximate the total well rate history as a series of constant rate steps. The Multilayer Predictive model would step through time, assuming a flowing wellhead pressure at each step. Calculation would proceed from the top of the well to the bottom, calculating first the sandface pressure, then the production rate, for each layer in turn. The Multilayer Predictive Model would then iterate to find the flowing wellhead pressure that gives the desired total well rate for the time step. The objective function would be based on flowing wellhead pressures instead of cumulative production. This modified procedure has the disadvantage that, for certain combinations of layer properties, there may be no wellhead pressure that will give the desired rate. The problem is particularly severe for low flowing wellhead pressures in high-pressure reservoirs, where only a small change in reservoir properties may require a large change in the flowing wellhead pressure to give the desired surface flow rate.

Nonlinear Regression Module

Further alternative embodiments of the invention would include, but are not limited to, any combination of the following modifications to the Nonlinear Regression Module:

1) Use of a different procedure for minimizing the objective function given by Eq. 32, such as the steepest descent method, Gauss-Newton method, or the downhill simplex method, all of which are described in detail in the literature.
2) Incorporation of prior information about the unknown parameters into the objective function, by adding a term as shown in Eq. 40:

$$F = A\sum_{j=1}^{N_{prod}}\left(\frac{G_{pcalc\ j} - G_{pobs\ j}}{G_{ptot}}\right)^2 + B\sum_{j=1}^{N_{pl}}\left[\sum_{k=1}^{N_{lay}}\left(\frac{q_{calc\ j,k} - q_{obs\ j,k}}{q_{tot\ j}}\right)^2\right] + C\sum_{j=1}^{N_{par}}\left(\frac{\alpha_j - \alpha_{prior\ j}}{\sigma_{\alpha,j}}\right)^2, \tag{40}$$

where $\{\alpha_j\}$ is the set of unknown model parameters, $\{\alpha_{prior\ j}\}$ is the set of prior estimates of the unknown parameters, and $\{\sigma_{\alpha,j}\}$ is the set of uncertainties in the prior estimates of the unknown parameters.

Advantages

From the description above, a number of advantages of my multilayer reservoir characterization method become evident:

(a) The method provides a comprehensive, coupled wellbore-reservoir model for computing the performance of a commingled reservoir system that rigorously accounts for pressure loss in tubing between layers as well as between the reservoir and the surface.

(b) The method provides forecasts performance of a commingled reservoir system accurately, rapidly, and efficiently, thereby making its use feasible for automatic history matching on a personal computer.

(c) The method provides an improved method of history matching production and production log data from commingled wells with a multilayer predictive model using specified surface pressure.

(d) The method provides improved estimates of individual layer properties for wells in commingled, multilayer reservoirs.

(e) The method provides estimates of individual layer properties without using an intermediate step of allocating production to individual layers.

(f) The method provides estimates of individual layer properties that are not biased by the choice of a method of allocating production to individual layers.

(g) The method provides accurate estimates of layer properties with fewer production logs than are required by the prior art.

(h) The method does not require specialized test equipment or procedures, since only surface production data and conventional production log data are used.

(i) The method provides accurate estimates of layer properties at reduced cost, thereby making application of the method cost effective for low productivity wells in low permeability gas reservoirs.

CONCLUSION, RAMIFICATIONS, AND SCOPE

Accordingly, the reader will see that the multilayer reservoir characterization and forecasting method of the present invention provides a comprehensive, coupled wellbore-reservoir model that can forecast reservoir performance rapidly and rigorously. In history matching mode, it can be used to estimate individual layer properties of a multilayer reservoir quickly, accurately, and economically from production and production log data, without requiring special testing procedures or equipment. Further, the method eliminates the need for an intermediate step of allocating production to individual layers and the attendant bias in the results so obtained.

Although the description above contains many specificities, these should not be construed as limiting the scope of the invention but as merely providing illustrations of the presently preferred embodiments of this invention. For example, the method could be changed to provide for single-phase flow of oil or water by appropriate modifications to the Single-Layer Predictive Model and the Tubing Pressure Gradient model. The method could also be modified to model two-phase flow of gas and water, two-phase flow of gas and condensate, two-phase flow of oil and gas, three-phase flow of gas, condensate, and water, or three-phase flow of oil, gas, and water, through use of a multiphase finite-difference simulator in the Single Layer Predictive Model and an appropriate multiphase tubing correlation in the Tubing Pressure Gradient Model.

Thus, the scope of the invention should be determined by the appended claims and their legal equivalents, rather than by the examples given.

REFERENCES

Cullendar, M. H., and Smith, R. V.: "Practical Solution of Gas-Flow Equations for Wells and Pipelines with Large Temperature Gradients," *Trans*. AIME (1956) 207, 281-287.

Dranchuk, P. M. and Abou-Kassem, J. H.: "Calculation of Z Factors for Natural Gases Using Equations of State," *JCPT* (July-September 1975) 34-36.

Ehlig-Economides, C.: "Process for Measuring Flow and Determining the Parameters of Multilayer Hydrocarbon Producing Formations," U.S. Pat. No. 4,803,873 (Feb. 14, 1989).

Ehlig-Economides, C.: "Method for Individually Characterizing the Layers of a Hydrocarbon Subsurface Reservoir," U.S. Pat. No. 5,247,829 (Sep. 28, 1993).

Fetkovich, M. J.: "Decline Curve Analysis Using Type Curves," *JPT* (June 1980) 1065-1077.

Fraim, M. L., and Wattenbarger, R. A.: "Gas Reservoir Decline-Curve Analysis Using Type Curves With Real Gas Pseudopressure and Normalized Time," *SPEFE* (December 1987) 671-682

Gill, P. E., Murray, W., and Wright, M. H.: *Practical Optimization*, Academic Press, London (1981) 136-137.

Guerillot, D., and Roggero, F.: "Method for Predicting, by Means of an Inversion Technique, the Evolution of the Production of an Underground Reservoir," U.S. Pat. No. 5,764,515 (Jun. 9, 1998).

Kucuk, F., and Ayestaran, L. C.: "Method for Uniquely Estimating Permeability and Skin Factor for at Least Two Layers of a Reservoir," U.S. Pat. No. 4,799,157 (Jan. 17, 1989).

Larkin, S. D., et al.: "Analysis of Completion and Stimulation Techniques in a South Texas Field Utilizing Comprehensive Reservoir Evaluation," paper SPE 93996 presented at the 2005 SPE Production and Operations Symposium, Oklahoma City, 17-19 April.

Lee, A. L., Gonzales, M. H., and Eakin, B. E.: "The Viscosity of Natural Gases," *JPT*, (August 1966) 997-1000.

Manrique, J. F., Poe, B. D. Jr., and England, K.: "Production Optimization and Practical Reservoir Management of Coalbed Methane Reservoirs," paper SPE 67315 presented at the 2001 SPE Production Operations Symposium, Oklahoma City, 26-28 March.

McCain, W. D. Jr.: *The Properties of Petroleum Fluids,* 2nd ed. PennWell Books, Tulsa, Olkahoma (1990).

Moridis, G. J., et al.: "The LaPlace Transform Finite Difference (LTFD) Numerical Method for the Simulation of Compressible Fluid Flow in Reservoirs," *SPE Advanced Technology Series*, Vol. 2 No. 2 (1994) 122-131.

Piper, L. D., McCain, W. D., and Corredor, J. H.: "Compressibility Factors for Naturally Occurring Petroleum Gases," paper SPE 26668 presented at the 68th Annual Technical Conference and Exhibition of SPE, Houston, 3-6 Oct. 1993.

Poe, B. D. Jr.: "Oil and Gas Reservoir Production Analysis Apparatus and Method," U.S. Pat. No. 6,101,447 (Aug. 8, 200).

Poe, B. D. Jr.: "Evaluation of Reservoir and Hydraulic Fracture Properties in Multilayer Commingled Reservoirs Using Commingled Reservoir Production Data and Production Logging Information," U.S. patent application Ser. No. 09/952,656, Pub. No. US 2002/0043370 A1.

Poe, B. D. Jr.: "Evaluation of Multilayer Reservoirs," WIPO Patent Application, International Pub. No. WO 02/23011 A1.

Press, W. H. et al., *Numerical Recipes in C,* $2^{nd}$ ed, Cambridge University Press, 1992.

Spivey, J. P., and Frantz, J. H. Jr.: "History Matching Production Data Using Analytical Solutions for Linearly Varying Bottomhole Pressure," paper SPE 29167 presented at the 1994 Eastern Regional Conference and Exhibition, Charleston, W. Va., 8-10 November.

Spivey, J. P., McCain, W. D. Jr., and North, R: "Estimating Density, Formation Volume Factor, Compressibility, Methane Solubility, and Viscosity for Oilfield Brines at Temperatures from 0 to 275° C., Pressures to 200 MPa, and Salinities to 5.7 mole/kg," *JCPT* (August 2004) 52-61.

Spivey, J. P., and Semmelbeck, M. E.: "Forecasting Long-Term Gas Production of Dewatered Coal Seams and Fractured Gas Shales," paper SPE 29580 presented at the 1995 Rocky Mountain Regional/Low-Permeability Reservoirs Symposium, Denver, 20-22 March.

Stein, M. H., and Carlson, F. M.: "Method for Characterizing Subterranean Reservoirs," U.S. Pat. No. 5,305,209 (Apr. 19, 1994).

*Theory and Practice of the Testing of Gas Wells,* 3rd edition, Energy Resources Conservation Board, Calgary (1975).

Watson, A. T., Lane, H. S., and Gatens, J. M., III: "History Matching With Cumulative Production Data," *JPT* (January 1990) 96-100.

Watson, A. T. et al: "An Analytical Model for History Matching Naturally Fractured Reservoir Production Data," SPERE (August 1990) 384-88.

Young, K. L: "Effect of Assumptions Used to Calculate Bottom-Hole Pressures in Gas Wells," *JPT* (April 1967) 547-550.

I claim:

1. A method for forecasting production for a well, said well having a wellbore and a wellhead, said wellbore penetrating a reservoir comprising a plurality of layers, said well producing fluid from said layers of said reservoir through said wellbore, said fluid from said layers being produced commingled within said wellbore, said method comprising:

(g) providing wellbore data describing said wellbore, (h) providing flowing wellhead pressure data representing the flowing wellhead pressure as a function of time for said well, (i) providing a forecast schedule representing a series of times at which a production forecast is desired, (j) providing layer data representing properties of each of said layers of said reservoir, (k) providing a plurality of single-layer predictive reservoir models corresponding to said layers, wherein the improvement comprises (l) providing a tubing pressure gradient model, (m) coupling said plurality of single-layer predictive reservoir models with said tubing pressure gradient model so as account for pressure drop between adjacent layers as well as between said wellhead and said reservoir, (n) computing for each time in said series of times a total well flow rate, a layer flow rate for each of said layers, and a flowing sandface pressure for each of said layers, whereby the computed total well flow rates represent a production forecast of said well at said series of times.

2. A method for forecasting production of a well, said well having a wellbore, said wellbore penetrating a reservoir comprising a plurality of layers, said well producing fluid from said layers of said reservoir through said wellbore, said fluid from said layers being produced commingled within said wellbore, said method comprising:

(a) providing wellbore data describing said wellbore, (b) providing flowing wellhead pressure data representing the flowing wellhead pressure as a function of time for said well, (c) providing a forecast schedule representing a series of times at which a production forecast is desired, (d) providing layer data representing properties of each of said layers of said reservoir, (e) providing an estimated wellhead flow rate representing the total well production rate at the first time-in said forecast schedule, (f) calculating from said wellbore data, said flowing wellhead pressure data, and said estimated wellhead flow rate a calculated first layer sandface pressure representing the flowing sandface pressure for the first layer of said reservoir at said first time in said forecast schedule, (g) calculating from said calculated first layer sandface pressure and said layer data a calculated first layer flow rate representing the flow rate from said first layer at said first time in said forecast schedule, (h) calculating a first calculated remaining wellbore flow rate representing the wellbore flow rate below said first layer by subtracting said calculated first layer flow rate from said estimated wellhead flow rate, (i) calculating from said first calculated remaining wellbore flow rate and said wellbore data a calculated second layer sandface pressure representing the flowing sandface pressure for the second layer of said reservoir at said first time, (j) calculating from said calculated second layer sandface pressure and said layer data a calculated second layer flow rate representing the flow rate from said second layer at said first time, (k) calculating a second calculated remaining wellbore flow rate representing the wellbore flow rate below said second layer by subtracting said calculated second layer flow rate from said first calculated remaining wellbore flow rate, (l) calculating a final calculated remaining wellbore flow rate by repeating steps (i) through (k) for all remaining layers of said reservoir, said final calculated remaining wellbore flow rate representing the difference between said estimated wellhead flow rate and the sun of the calculated layer flow rates, (m) updating said estimated wellhead flow rate, (n) repeating steps (f) through (l) until said final calculated remaining wellbore flow rate is less than a predetermined value, (o) displaying said final calculated wellbore flow rate, (p) repeating steps (e) through (n) for the remaining times in said forecast schedule, whereby the estimated wellhead flow rates represent a production forecast of said well at said series of times.

3. The method of claim 2 wherein said fluid is selected from the group consisting of gas, oil, water, a mixture of gas and water, a mixture of gas and condensate, a mixture of gas, condensate, and water, a mixture of oil and water, a mixture of oil and gas, and a mixture of oil, gas, and water.

4. A method for characterizing a reservoir comprising a plurality of layers, said layers of said reservoir being penetrated by a well, said well producing fluid from said layers of said reservoir, said fluid from said layers being produced commingled in said well, said well having been produced for a period of time, said well having had at least one production log run during said period of time, said method comprising:

(a) providing a multi layer predictive reservoir model or said reservoir, said multilayer predictive reservoir model comprising a plurality of single-layer predictive reservoir models coupled with a tubing pressure gradient model, said multilayer predictive reservoir model being characterized by a plurality of known parameters representing known properties of said layers of said reservoir and a plurality of unknown parameters representing unknown properties of said layers of said reservoir, (b) providing first raw data representing an observed production history of said well during said period of time, (c) providing second raw data representing observed production log data from said production log, (d) providing third raw data representing values of said plurality of known parameters, (e) providing fourth raw data representing initial estimates of said plurality of unknown parameters, (f) providing first means for computing from said multilayer predictive reservoir model a first set of calculated values representing a synthetic production history for said period of time, said synthetic production history corresponding to said observed production history, (g) providing second means for computing from said multilayer predictive reservoir model a second set of calculated values representing synthetic production log data, said synthetic production log data corresponding to said observed production log data, (h) providing third means for automatic history matching said observed production history and said observed production log data by computing a third set of calculated values, said third set of calculated values representing final estimates of said plurality of unknown parameters, said final estimates providing a match between said synthetic production history and said observed production history and between said synthetic production log data and said observed production log data, and (i) providing fourth means of displaying said final estimates of said plurality of unknown parameters, whereby said final estimates are estimates of said unknown properties of said layers of said reservoir, said final estimates having been obtained using only said observed production history, said observed production logs, said values of said plurality of known parameters, and said initial estimates of said plurality of unknown parameters.

5. The method of claim 4 wherein said third means for automatic history matching is a means for minimizing the value of an objective function by non-linear regression, said objective function being a sum of a plurality of terms, one term of said plurality of terms being a weighted sum of squares of differences between said synthetic production history and said observed production history, a second term of said plurality of terms being a weighted sum of squares of differences between said synthetic production log data and said observed production log data.

6. The method of claim 5 wherein said objective function further includes a third term, said third term representing a weighted sum of squares of differences between said initial estimates of said plurality of unknown parameters and said final estimates of said plurality of unknown parameters.

7. The method of claim 4 wherein said plurality of single layer predictive reservoir models are selected from the group consisting of analytical reservoir models, numerical reservoir simulation models, and deliverability/material balance models.

8. The method of claim 7 wherein said plurality of single layer predictive reservoir models are analytical reservoir models.

9. The method of claim 8 wherein said analytical reservoir models are based on constant terminal rate solutions.

10. The method of claim 8 wherein said analytical reservoir models are based on linearly changing terminal rate solutions.

11. The method of claim 8 wherein said analytical reservoir models are based on constant terminal pressure solutions.

12. The method of claim 8 wherein said analytical reservoir models are based on linearly changing terminal pressure solutions.

13. The method of claim 4 wherein said observed production history is selected from the group consisting of cumulative production history, incremental production history, and production rate history.

14. The method of claim 4 wherein said observed production log data is selected from the group consisting of layer flow rate data, layer fractional flow rate data, running total flow rate data, and incremental running total flow rate data.

* * * * *